US010988309B2

(12) United States Patent
Morrison et al.

(10) Patent No.: US 10,988,309 B2
(45) Date of Patent: Apr. 27, 2021

(54) REVERSE VENDING MACHINE SYSTEM

(71) Applicant: Terraboost Media LLC, Miami, FL (US)

(72) Inventors: Brian L Morrison, Miami Beach, FL (US); Michael Chen, Xiangtan (CN)

(73) Assignee: Terraboost Media LLC, Miami, FL (US)

( * ) Notice: Subject to any disclaimer, the term of this patent is extended or adjusted under 35 U.S.C. 154(b) by 0 days.

(21) Appl. No.: 16/247,455

(22) Filed: Jan. 14, 2019

(65) Prior Publication Data

US 2019/0218027 A1 Jul. 18, 2019

Related U.S. Application Data

(60) Provisional application No. 62/617,282, filed on Jan. 14, 2018.

(51) Int. Cl.
*B65F 1/14* (2006.01)
*G07F 7/06* (2006.01)

(52) U.S. Cl.
CPC ..... *B65F 1/14* (2013.01); *G07F 7/0609* (2013.01)

(58) Field of Classification Search
CPC ..... B65F 1/14; B65F 1/1405; G07F 7/0609; B02C 18/142; B30B 9/325
USPC ..... 232/44; 194/208, 209; 100/49; 220/908, 908.3; 241/100
See application file for complete search history.

(56) References Cited

U.S. PATENT DOCUMENTS 4,573,641 A * 3/1986 DeWoolfson ..... B02C 19/0087 194/205
4,653,627 A * 3/1987 Hampson ..... B30B 9/3007 100/902
4,953,682 A * 9/1990 Helbawi ..... G07F 7/0609 100/902
4,989,507 A * 2/1991 Rhoades ..... B30B 9/321 100/144
5,215,265 A * 6/1993 Lodovico ..... B02C 19/0087 241/158
5,226,519 A * 7/1993 DeWoolfson ..... B65F 1/1405 194/209
5,441,160 A * 8/1995 DeWoolfson ..... B65F 1/1405 209/702
5,469,783 A * 11/1995 Fry ..... B30B 9/325 100/173
5,477,953 A * 12/1995 Powell ..... G07F 7/0609 194/209
5,560,552 A * 10/1996 Powell ..... B02C 18/142 241/100
5,921,372 A * 7/1999 Millhiser ..... B02C 18/142 194/209
5,927,462 A * 7/1999 Kiva ..... B30B 9/32 100/902

(Continued)

*Primary Examiner* — William L Miller
(74) *Attorney, Agent, or Firm* — Quantum Patent Law Firm

(57) ABSTRACT

A reverse vending machine to be utilized as a recycled material collection device. The reverse vending machine is comprised of a housing having an aperture disposed therethrough, the aperture configured to receive a plurality of recyclable materials from a user. A ducting system is in fluid communication with the aperture and a vacuum system to draw the plurality of recyclable materials to an auger system configured to compact the recyclable materials and dispose the recyclable materials into a reservoir.

15 Claims, 6 Drawing Sheets

(56) References Cited

U.S. PATENT DOCUMENTS 6,186,308 B1 * 2/2001 Coyne ..... G07F 7/0609
194/209
8,851,265 B2 * 10/2014 Morishita ..... B08B 3/02
194/208

* cited by examiner

REVERSE VENDING MACHINE SYSTEM

CROSS-REFERENCE TO RELATED APPLICATIONS

This application claims priority to U.S. Provisional Application 62/617,282 entitled "Reverse Vending Machine System and Method" and filed Jan. 14, 2018, which is hereby incorporated by reference in its entirety.

FIELD

The present invention generally relates to a system for a reverse vending machine utilized for the collection of recycled materials.

BACKGROUND

Reverse recycling machines are known to collect recyclable items such as aluminum cans and plastic bottles and return money to the dispensing user. These machines are common in areas wherein recycling is government mandated or encouraged.

With the increase in population, the utilization of single-use plastics has increased dramatically leaving pollution in the wake. The need to recycle these single-use plastics has led to legislation mandating fees for their consumption to promote more sustainable means of their utility.

In the current art, many reverse vending machines are utilized having a form of user interface, whether graphical or push-button implemented. The machines typically are comprised of a collection reservoir wherein recycled cans and bottles are stored for consumption. Various statutes, OSHA, and industry standards maintain appropriate collection standards including collection weight or volume. Each of these should be adhered to in the invention described herein. While many of these are related to recyclable cans and bottles few, if any, are optimized for plastic bags offering a graphical user interface wherein advertisements may be illustrated.

Further, current art allows users to submit recyclable materials into the machine without prohibiting unwanted materials from entering. This may cause loss of valuable items as well as safety hazards and damage to the machines internal components.

SUMMARY OF THE INVENTION

Embodiments described herein provide for a reverse vending machine to be utilized as a recycled material collection device. The reverse vending machine is comprised of a housing having an aperture disposed therethrough, the aperture configured to receive a plurality of recyclable materials from a user. A ducting system is in fluid communication with the aperture and a vacuum system to draw the plurality of recyclable materials to an auger system configured to compact the recyclable materials and dispose the recyclable materials into a reservoir.

In one aspect, the housing is further comprised of a user interface in electrical communication with a printed circuit board.

In one aspect, the housing is further comprised of a door affixed to the housing via a hinge, wherein the door permits access to the reservoir, ducting system, and auger system.

In one aspect, the reservoir is removable from the housing.

In one aspect, a sensor is in operable communication with the printed circuit board. The sensor positioned to sense the presence of recyclable materials inserted into the aperture. In some embodiments, the sensor can be a motion sensor.

In one aspect, the auger system is comprised of an auger motor positioned on an auger holder block.

In another aspect, a method for recycling recyclable materials includes the steps of selecting a service within a user interface in communication with a reverse vending machine and inserting the recycled materials into an aperture. The recyclable materials are driven, via vacuum, through a ducting configuration to an auger system wherein the recyclable materials are compacted. The recycled materials are then dispensed into a reservoir which may be removed for collection.

These and other features and advantages will become apparent from the following detailed description of illustrative embodiments thereof, which is to be read in connection with the accompanying drawings.

BRIEF DESCRIPTION OF THE DRAWINGS

A more complete understanding of the embodiments, and the attendant advantages and features thereof, will be more readily understood by references to the following detailed description when considered in conjunction with the accompanying drawings wherein.

DETAILED DESCRIPTION

Figure 1:
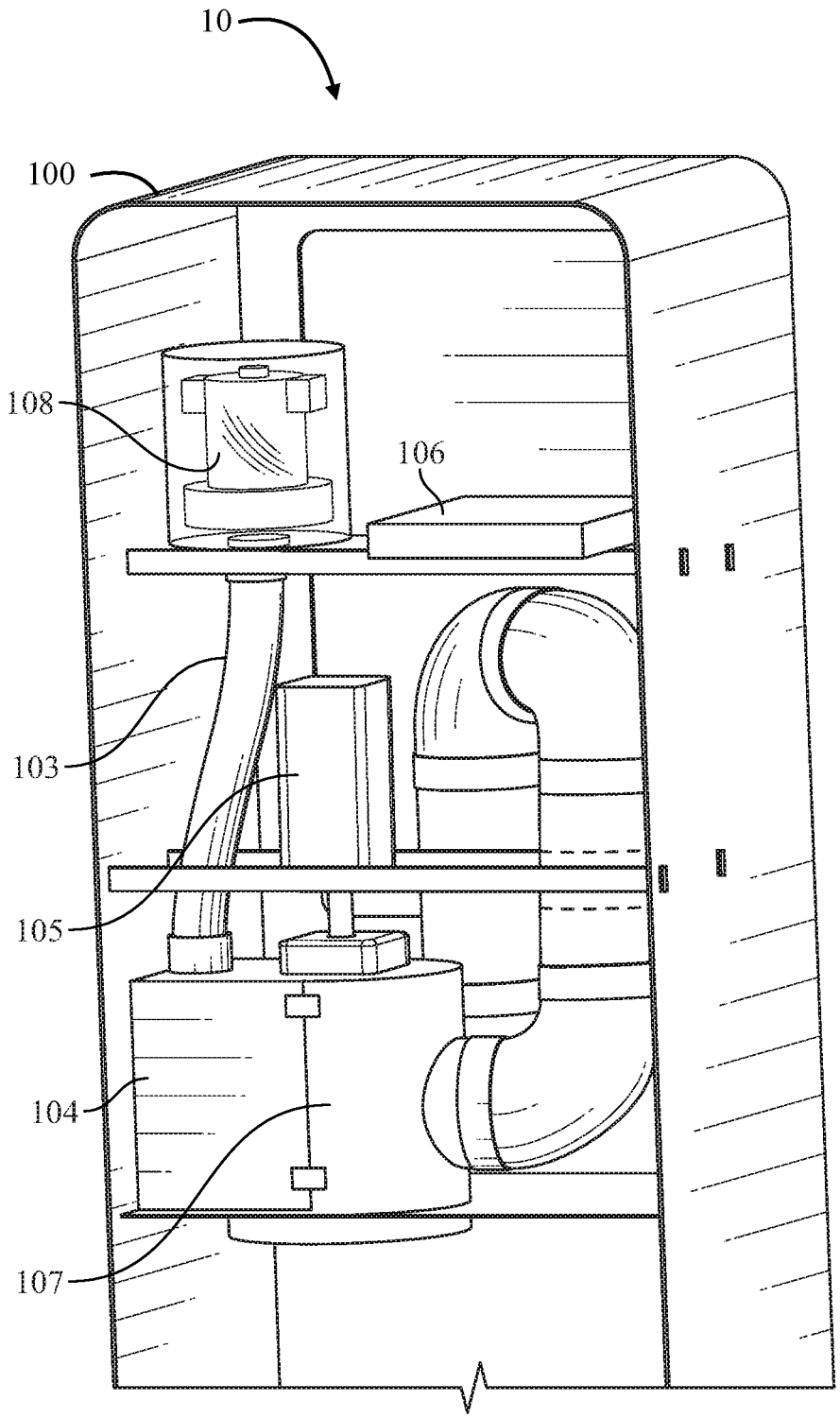
FIG. 1 illustrates a partial front perspective view of the reverse vending machine system, according to some embodiments.
Figure 2:
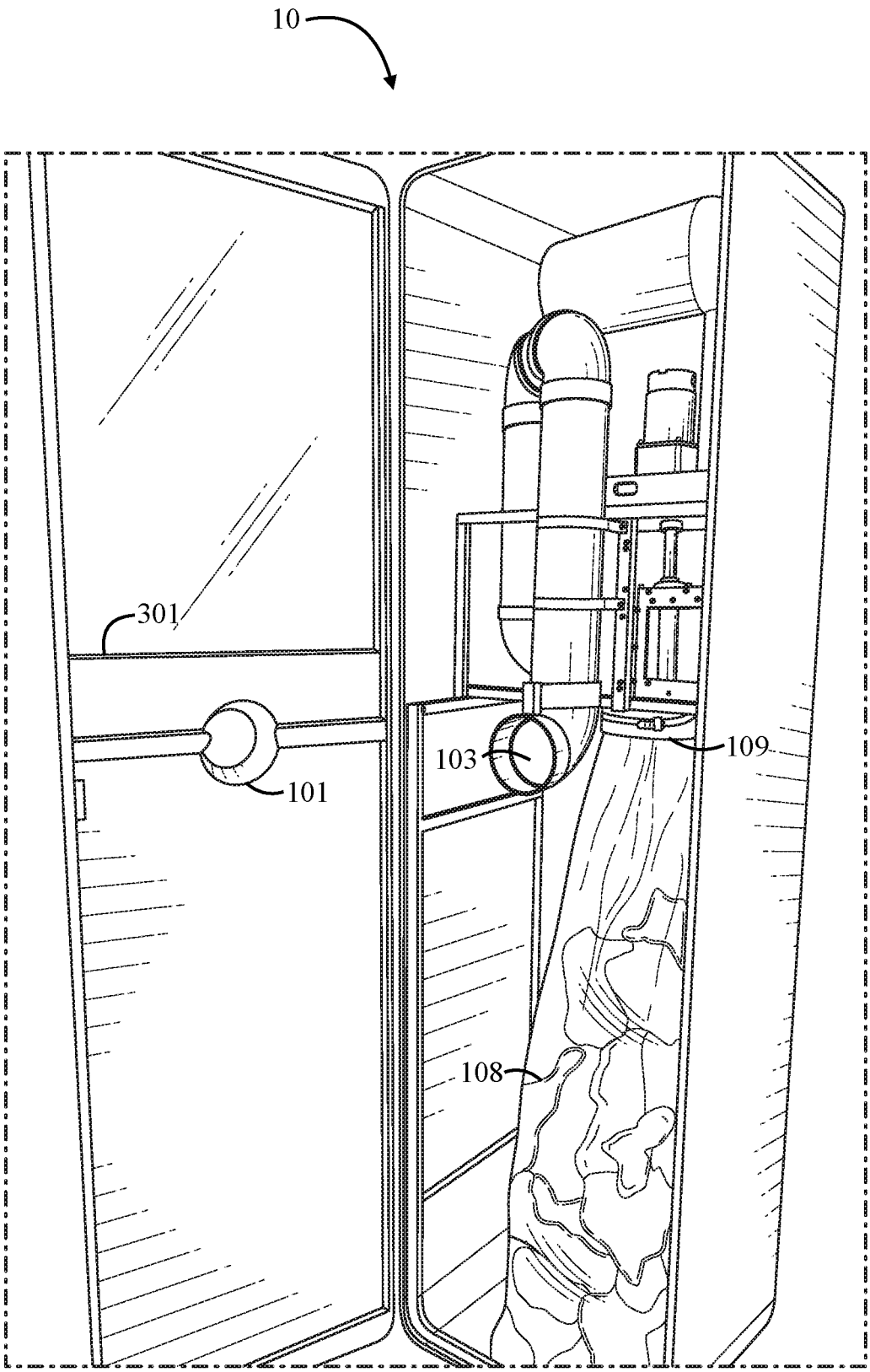
FIG. 2 illustrates a front perspective view of the reverse vending machine system with the door in an open configuration to show the internal components, according to some embodiments.
Figure 3:
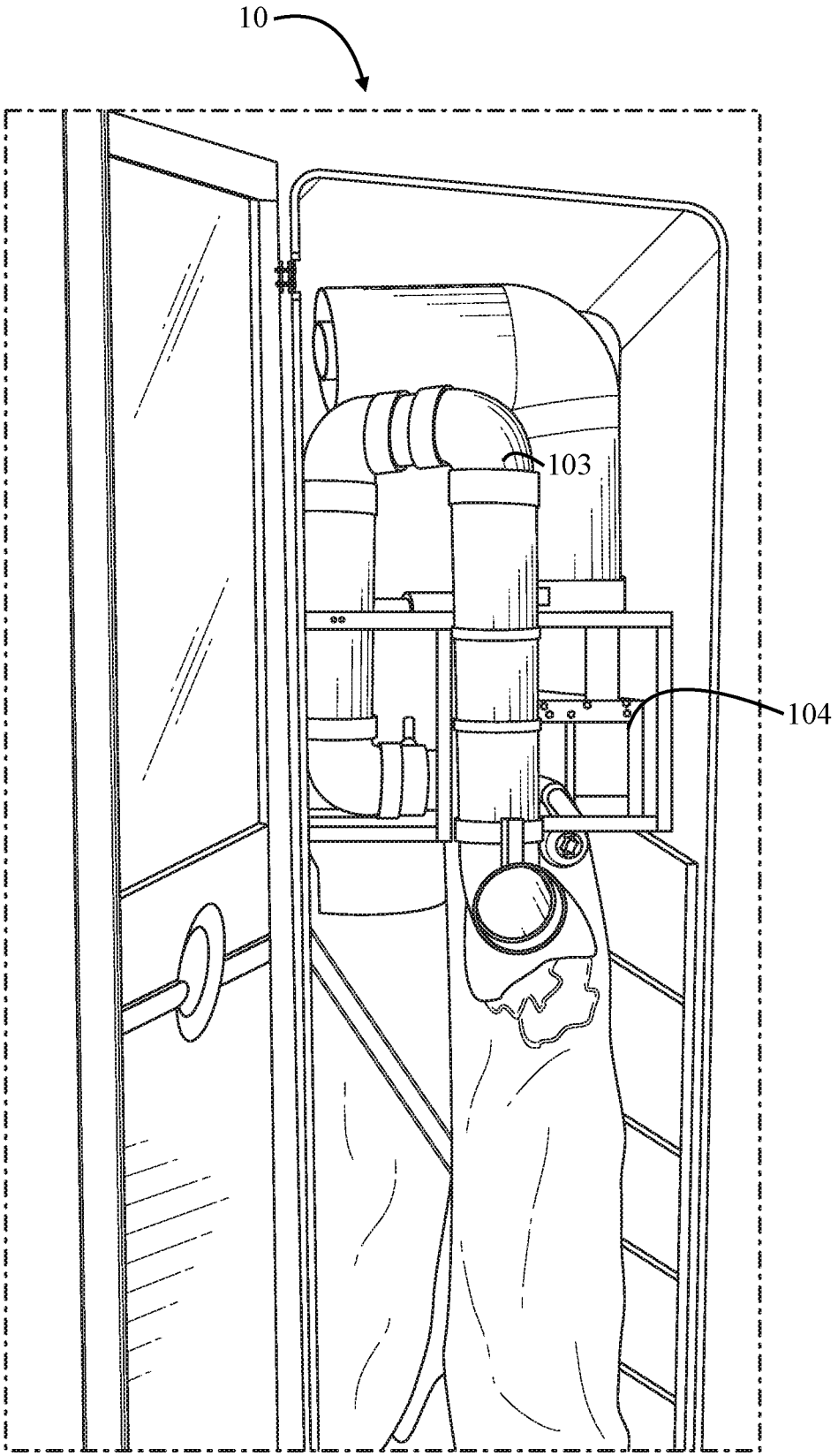
FIG. 3 illustrates a front perspective view of the reverse vending machine system, according to some embodiments.
Figure 4:
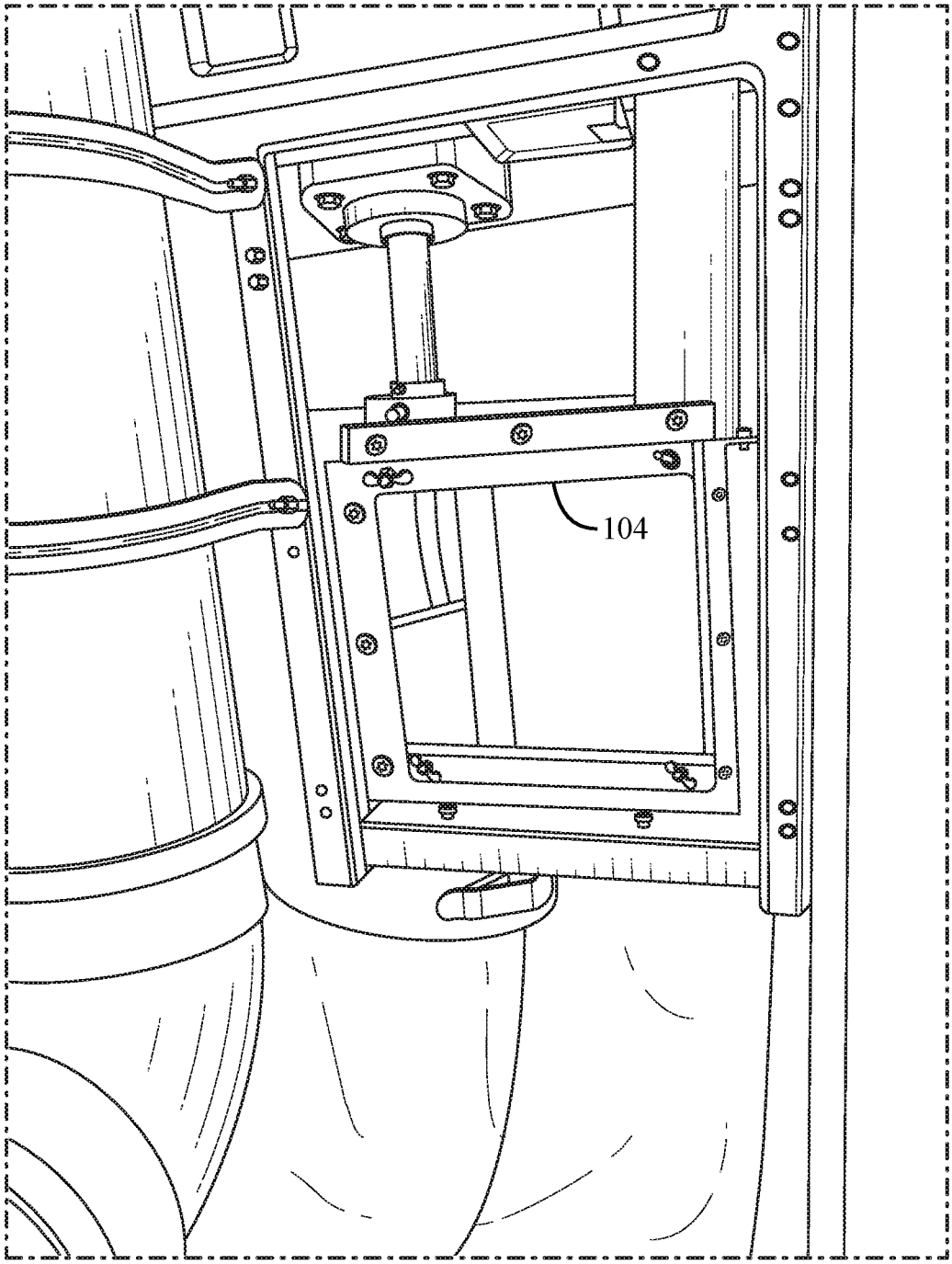
FIG. 4 illustrates a detail view of the secondary door enclosing the auger system, according to an embodiment of the present invention.

The specific details of the single embodiment or variety of embodiments described herein are set forth in this application. Any specific details of the embodiments are used for demonstration purposes only, and no unnecessary limitation or inferences are to be understood therefrom.

Any reference to "invention" within this document is a reference to an embodiment of a family of inventions, with no single embodiment including features that are necessarily included in all embodiments, unless otherwise stated. Furthermore, although there may be references to "advantage's" provided by some embodiments, other embodiments may not include those same advantages or may include different advantages. Any advantages described herein are not to be construed as limiting to any of the claims.

Before describing in detail exemplary embodiments, it is noted that the embodiments reside primarily in combinations of components related to the wireless speaker set and flexible mounting means. Accordingly, the system and method components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

As used herein, relational terms, such as "first" and "second," "top" and "bottom," and the like, may be used solely to distinguish one entity or element from another entity or element without necessarily requiring or implying any physical or logical relationship or order between such entities or elements.

Specific quantities, dimensions, spatial characteristics, compositional characteristics and performance characteristics may be used explicitly or implicitly herein, but such specific quantities are presented as examples only and are approximate values unless otherwise indicated. Discussions and depictions pertaining to these, if present, are presented as examples only and do not limit the applicability of other characteristics unless otherwise indicated.

In general and as shown in FIGS. 1-4, the embodiments described herein relate to a reverse vending machine which selectively receives specific recyclable materials from a user. A housing 100 includes at least one user interface 200 permitting the user to engage with the reverse vending system 10, such as by selecting from various recyclable materials 108, inputting, receiving, or transmitting compensation, and engaging with advertisements displayed on the user interface 200. The housing 100 is configured to selectively receive a plurality of recyclable materials such as plastic bags such as those commonly used to contain groceries, produce, bulk foods, product packaging, or similar consumer-associated plastics.

In some embodiments, an aperture 101 is positioned through the housing 100. The aperture is dimensioned to receive recyclable materials 108, which in the present embodiment are plastic bags. The housing 100 may be comprised of a hinged door 301 permitting maintenance personnel to open the hinged door 301 and access the internal assembly 102.

Once opened, a secondary door 104 covers specific internal components and selectively permits access thereto. For example, the secondary door 104 may enclose an auger motor 105 assembly permitting maintenance personnel to access its components.

In an embodiment, a sensor 204 may be positioned near the aperture 101 to detect the proximity of the user, insertion of the recyclable material 108, determine the insertion of acceptable or unacceptable materials to preserve the operability of the machine, or other forms of sensing the user, the components of the system 10, and the recyclable materials provided to the machine by the user. In a preferred embodiment, the sensor 104 detects the insertion of a plastic bag through the aperture 101 and causes suction to be generated through the ducting 103 to forcibly draw the recyclable materials to a reservoir 109.

As the sensor detects the presence of a plastic bag or the insertion thereof, the vacuum motor is turned on by the processor or similar implement. The vacuum is in fluid communication with ducting 103 causing the ingress of air through the aperture 101. The processor is programmed to instruct the vacuum to generate a predetermined amount of suction to such that plastic bags are selectively received by the device. The lack of sufficient suction prohibits unwanted items such as bottles, cans, and small objects to be transmitted through the ducting 103.

In an embodiment, an auger motor 105 and auger holder block 107 is disposed within the housing to effectively compact the recyclable materials 108 (such as plastic bags). Once the plastic bags have been input by the user, the force of the vacuum suction draws the bags through the auger wherein they are compacted to be efficiently stored in a reservoir 109 configured to receive the bags from the aperture 101.

One skilled in the arts may appreciate that a compactor, baler, or similar apparatus may be used to efficiently store the recycled materials.

The reservoir 109 may be dimensioned to receive a predetermined volume or weight to comply with either physical limitations of the maintenance personnel who must remove the reservoir 109 when full, as well as regulatory standards such as those imposed by the Occupational Safety and Health Administration ("OSHA"). In the instant embodiment, the reservoir capacity is forty pounds or less to comply with OSHA standards.

Preferentially, the reservoir 109 is constructed of a lightweight material such as a plastic or composite to increase the weight capacity that can be disposed therein. The material must be able to sufficiently support the overall weight of the reservoir without tearing or stretching.

In an embodiment, the reservoir 109 is removably engaged with the ducting 103 using a receiving means 111. This permits the reservoir to be substantially hermetically engaged with the ducting and reduce spillage of contents.

In an embodiment, a printed circuit board ("PCB") may be utilized to electrically connect the electrical components of the device; including but not limited to the vacuum motor, auger motor, user interface, sensors, and any other electronic implement internal or external of the device.

The user interface means 200 may include one or a combination of user interface means 200 known in the arts including a graphical user interface such as an LED display 210. The graphical user interface may be in electrical communication with one or more processors, and a network of remote users and/or servers. The processor may instruct the graphical user interface to direct the user through a recycling protocol, convey advertisements and media to the user, prompt for donations or payments, and provide other information commonly associated with the arts. Data related to each transaction may be stored in an internal or external data storage device. One or more servers may be utilized in order to serve data to and from the network.

In an embodiment, the graphical user interface may alert the user, including maintenance personnel of a need for service of the device. This may include alerts for having a full materials reservoir, a jam in the ducting, or other maintenance requirements.

In another embodiment, an alert may prompt the processor to message an external administrator of the maintenance requirement of the system 10.

Figure 5:
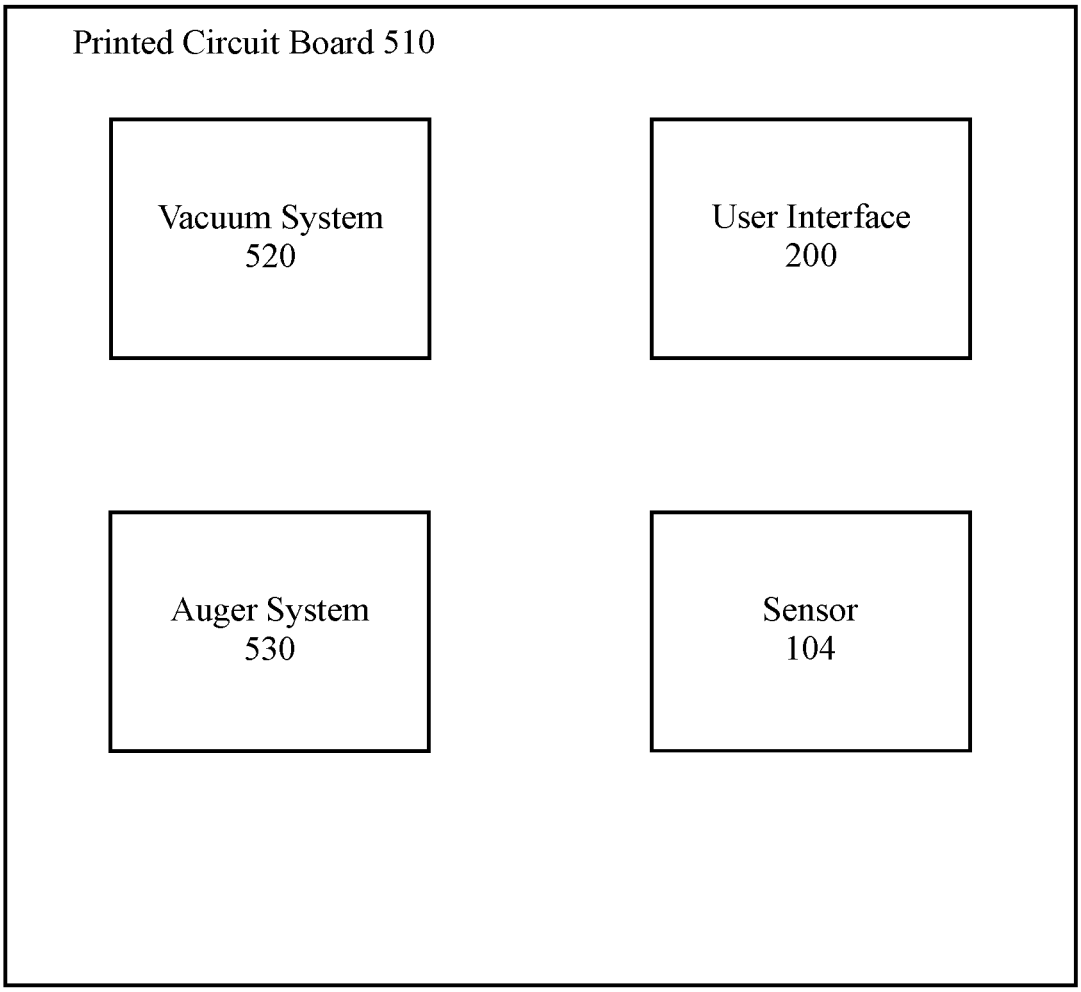
FIG. 5 illustrates a block diagram of the electrical components, according to some embodiments.

FIG. 5 illustrates a block diagram of the electrically connected components of the reverse vending machine system 10. The user interface 200 is in electrical communication with the printed circuit board 510 which executed functions stored in the processor to receive and collect recyclable materials. The printed circuit board 510 causes the vacuum system 520 to generate suction upon the sensing of recyclable materials into the aperture. The recyclable materials may be sensed by the sensor 104. The printed circuit board may also cause the operation of the auger system 530 once the recyclable materials are driven via vacuum suction generated by the vacuum system through the ducting system to the auger system 530. In some embodiments, a reservoir sensor 540 may determine via weight and/or volume the readiness of the reservoir for collection. In one example, the reservoir sensor 540 determines a maximum weight of total recyclable materials within the reservoir and alerts the user or maintenance personnel of the exceeded limit such that the reservoir may be collected and replaced.

Figure 6:
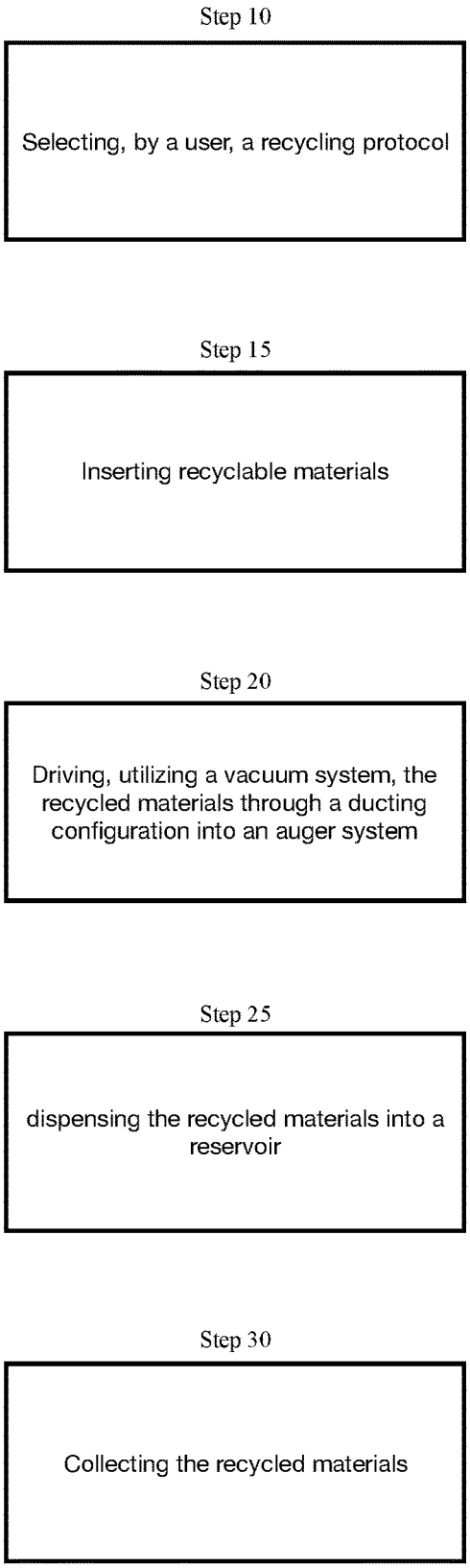
FIG. 6 illustrates a flowchart of a method of utilizing the reverse vending machine to receive and collect recyclable materials.

A method of recycling materials such as a plurality of plastic bags is disclosed and illustrated in FIG. 6. In Step 10, a user engages with a user interface to select an appropriate protocol for the dispensing materials. In step 15 the user inserts specific materials into the aperture to be vacuum-driven through the ducting. In step 20, recyclable materials are dispensed into the auger wherein they are compacted as they travel through the auger. In step 25, the compacted materials are dispensed into the reservoir wherein they are stored. In step 30, a user may open the housing to collect the full reservoir and offload at an appropriate recycling location.

In yet another embodiment, the device may be utilized as a means for advertising to the primary user, as well as others within the line of sight of the device. In so, the GUI may be programmed to display advertisements when the device is not in use. This may be accomplished by the sensor affecting the processor to display the advertisements when no user is within a specified range. In another embodiment, advertisements may be displayed after a time interval without use of the device.

It will be appreciated by persons skilled in the art that the present embodiment is not limited to what has been particularly shown and described hereinabove. A variety of modifications and variations are possible in light of the above teachings without departing from the following claims.

What is claimed is:

1. A reverse vending machine comprising:

a housing having an aperture disposed on the housing, the aperture configured to receive a plastic bag from a user;

a ducting system in fluid communication with the aperture;

a vacuum system;

an auger system; and a reservoir, wherein the vacuum system is configured to draw the plastic bag to the auger system which is configured to compact the plastic bag and dispose the plastic bag into the reservoir, and wherein the vacuum system is configured to generate a given amount of suction force that is sufficient to move the plastic bag through the ducting system and into the reservoir but insufficient to move heavier items through the ducting system and into the reservoir.

2. The reverse vending machine of claim 1, wherein the housing further comprises a user interface in electrical communication with a printed circuit board.

3. The reverse vending machine of claim 2, wherein the housing comprises a door affixed to the housing via a hinge, and the door permits access to the reservoir, the ducting system, and the auger system.

4. The reverse vending machine of claim 3, wherein the reservoir is removable from the housing.

5. The reverse vending machine of claim 2, further comprising a sensor in operable communication with the printed circuit board, the sensor positioned to sense the presence of the plastic bag inserted into the aperture.

6. The reverse vending machine of claim 5, wherein the sensor is a motion sensor.

7. The reverse vending machine of claim 1, wherein the auger system comprises an auger motor positioned on an auger holder block.

8. A reverse vending machine comprising:

a housing having an aperture disposed on the housing, the aperture configured to receive a plastic bag from a user;

a printed circuit board;

a ducting system;

an auger system;

a removable reservoir; and a sensor in operable communication with the printed circuit board, the sensor positioned to sense the presence of the plastic bag inserted into the aperture and cause vacuum suction to be generated within the ducting system in fluid communication with the aperture to draw the plastic bag to the auger system which is configured to compact the plastic bag and dispose the plastic bag into the removable reservoir, wherein the vacuum suction is sufficient to move the plastic bag through the ducting system and into the removable reservoir but insufficient to move heavier items through the ducting system and into the removable reservoir.

9. The reverse vending machine of claim 8, wherein the housing further comprises a user interface in electrical communication with the printed circuit board.

10. The reverse vending machine of claim 8, wherein the sensor is a motion sensor.

11. The reverse vending machine of claim 8, wherein the housing further comprises a door affixed to the housing via a hinge, wherein the door permits access to the reservoir, the ducting system, and the auger system.

12. The reverse vending machine of claim 8, wherein the auger system comprises an auger motor positioned on an auger holder block.

13. A method of recycling a plastic bag, the method comprising:

providing an aperture on a reverse vending machine comprising a ducting system, an auger system, a vacuum system, and a reservoir; the aperture, the ducting system, the auger system, and the reservoir being in communication with one another;

generating with the vacuum system suction force that is sufficient to move the plastic bag through the ducting system and into the reservoir but insufficient to move heavier items through the ducting system and into the reservoir;

compacting the plastic bag using the auger system and dispensing the plastic bag into the reservoir; and collecting the plastic bag.

14. The method of claim 13, wherein the reverse vending machine comprises:

a housing having the aperture disposed on the housing, the aperture configured to receive the plastic bag from a user, the ducting system;

the auger system;

the reservoir; and the vacuum system to draw the plastic bag to the auger system configured to dispose the plastic bag into the reservoir.

15. The method of claim 13, wherein the aperture comprises a sensor in operable communication with a printed circuit board.

* * * * *